United States Patent [19]

Bader

[11] 4,237,941

[45] Dec. 9, 1980

[54] LOOM WITH COVER ARRANGEMENT

[75] Inventor: Hartmann Bader, Winterthur, Switzerland

[73] Assignee: Sulzer Brothers Limited, Winterthur, Switzerland

[21] Appl. No.: 890,795

[22] Filed: Mar. 27, 1978

[30] Foreign Application Priority Data

Apr. 21, 1977 [CH] Switzerland ..... 004946/77

[51] Int. Cl.[2] ..... D03J 1/00

[52] U.S. Cl. ..... 139/1 C

[58] Field of Search ..... 139/1 R, 1 C; 57/56, 57/300, 304; 19/107, 236; 98/115

[56] References Cited

U.S. PATENT DOCUMENTS 3,311,135 3/1967 Maguire et al. ..... 139/1 C 3,378,998 4/1968 Shackelford ..... 139/1 C 3,627,201 12/1971 Partsch ..... 139/1 C

FOREIGN PATENT DOCUMENTS 2527866 12/1976 Fed. Rep. of Germany ..... 139/1 C 2529729 12/1976 Fed. Rep. of Germany ..... 139/1 C

*Primary Examiner*—Henry Jaudon

*Attorney, Agent, or Firm*—Werner W. Kleeman

[57] ABSTRACT

A loom having a deflection beam at the side of the warp for the warp ends and a deflection beam at the side of the cloth for the woven cloth, the deflection beams essentially delimiting the weaving plane containing the shed forming mechanism and the reed. A cover arrangement extends only above the weaving plane essentially from the deflection beam at the side of the warp up to the deflection beam at the side of the woven cloth.

7 Claims, 11 Drawing Figures

LOOM WITH COVER ARRANGEMENT

BACKGROUND OF THE INVENTION

The present invention relates to a loom equipped with a cover arrangement, the loom being of the type comprising a deflection beam for the warp ends located at the side of the warp and a deflection beam at the side of the cloth, these deflection beams essentially limiting the weaving plane containing the shed forming mechanism and the reed.

With heretofore known looms of this general type, for instance as disclosed in German patent publication No. 2,529,729 and U.S. Pat. No. 3,627,201, there is provided a cover arrangement for the entire loom.

Furthermore, there is known from German patent publication No. 2,527,866 a loom having a sound absorbing cover extending only from the harnesses up to the breast beam.

The prior art complete cover arrangement is bulky and expensive. The parts of the loom are only accessible after raising the entire hood of the cover arrangement. The known partial cover arrangement, while allowing for relatively easier accessiblity to certain of the parts of the loom, nonetheless only affords relatively limited sound insulation or absorption.

Therefore, with the foregoing in mind, it is a primary object of the present invention to provide a loom which is improved with regard to these aspects.

Still a further significant object of the present invention aims at providing a cover arrangement for a loom which, while affording good acoustical insulation, also enables easy access to parts of the loom.

Yet a further significant object of the present invention aims at the provision of a new and improved cover arrangement for use in conjunction with a loom, rendering ready access to parts of the loom, while providing good acoustical insulation, and which cover arrangement is relatively simple in construction and design, economical to manufacture, easy to use, and requires a minimum of maintenance and servicing.

Now in order to implement these and still further objects of the invention, which will become more readily apparent as the description proceeds, a cover arrangement is provided for the loom which essentially extends from the deflection beam at the side of the warp to the deflection beam at the side of the cloth. In this way, there can be accomplished a maximum acoustical insulation with relatively good accessibility of the important parts of the loom. On the one hand, the noise which is propagated at the neighborhood of the machine, and which predominantly is directed upwardly and towards the sides, is absorbed for the most part by the cover arrangement or reflected towards the ground. On the other hand, the warp beam and cloth beam or roller, as well as the loom drive are freely accessible. The warp, the warp stop-motion, harnesses, reed and weft insertion mechanism, after carrying out very few manipulations, for instance opening flaps or the like, are accessible.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
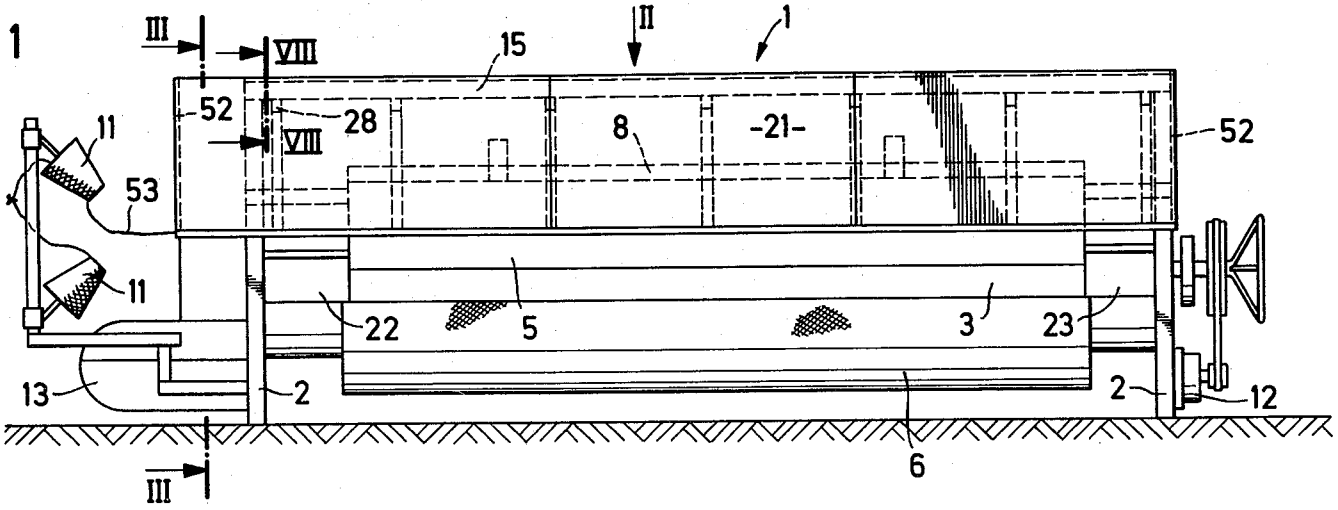
FIG. 1 is a front view of a loom constructed according to the teachings of the present invention.

Describing now the drawings, it is to be understood that for purposes of simplifying the illustration thereof, only enough of the structure of the loom has been shown to enable those skilled in the art to readily understand the underlying principles and concepts of the present development. The loom, generally designated in its entirety by reference character 1, will be seen to contain two side plates or walls 2, a warp beam 3, a deflection beam 4 (tension beam or roller) at the side of the warp ends and at the side of the cloth a deflection beam 5 as well as a cloth beam or roller 6. The warp 10 is guided from the warp beam 3 over the deflection beam 4, while forming the rear shed 7 by means of the harnesses 8, and then while forming the front shed 9 over the deflection beam or roller 5 to the cloth beam 6. At that location the cloth 20 which is formed at the front shed 9 is wound-up. The filling or weft threads or yarn 53 are drawn off the filling bobbins 11 and inserted into the front shed 9 from the filling insertion mechanism 22 to the catcher mechanism 23. The drive motor has been designated by reference character 12, and an eccentric mechanism 13 which drives the harnesses 8 has been designated by reference character 13.

Figure 3:
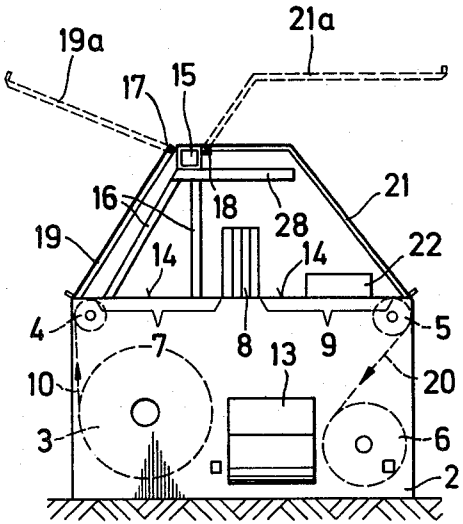
FIG. 3 is a cross-sectional view, taken substantially along the line III—III of FIG. 1.

Above the weaving plane 14, extending from the deflection beam 4 up to the deflection beam 5, there is supported upon the supports or struts 16 a longitudinal beam or support member 15. Hingedly connected at the hinge locations 17 and 18 are the flap or cover members 19 and 21, respectively, which are preferably formed of any suitable transparent material. When these articulated flap members 19 and 20 assume the full-line closed position, as shown in FIG. 3, they completely cover the weaving plane 14. The rear flap or cover members 19 cover the rear shed 7, whereas the front flap or cover members 21 cover the front shed 9. These flap members 19 and 21 can be manually brought into the servicing position **19*a* and 21*a* shown in phantom lines in FIG. 3, at which servicing position the parts of the warp 10 and the cloth 20 located in the weaving plane 14 as well as particularly the harnesses 8 and the weft or filling insertion elements between the filling insertion mechanism 22 and the catcher mechanism 23** are freely accessible.

Figure 4:
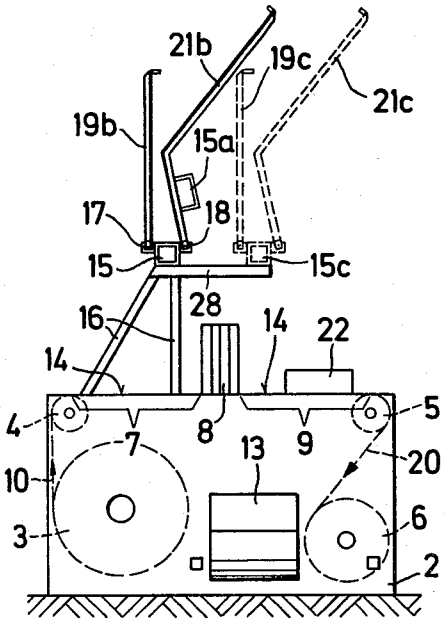
FIG. 4 illustrates further positions of the cover arrangement for the loom, essentially corresponding to the showing of FIG. 3.

The flap members 19 and 21 furthermore can be brought into the vertical position **19*b* and 21*b*, respectively, shown in full-lines in FIG. 4, so that the parts of the loom located therebelow are even further accessible, particularly in the event that they must be dismantled. The longitudinal beam 15 together with the therewith articulated flap members 19 and 21 are mounted for displacement towards the right of FIG. 4 upon the horizontal rails 28 and can be conveniently fixed in position. The parts then assume the phantom line positions 15***c*, 19*c*, 21*c* illustrated in FIG. 4, wherein, for instance, the harnesses 8 can be particularly easily dismantled and again installed by means of a crane or other suitable lifting or hoisting device. A screw connection for fixing the longitudinal beam or support 15 can be provided, as has been shown by reference character 24 in FIG. 11 by way of example.

Figure 5:
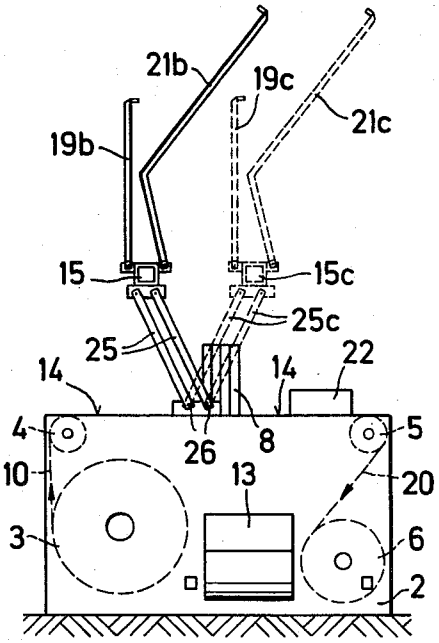
FIG. 5 is a cross-sectional view, like the showing of FIG. 3, of a modified exemplary embodiment.
Figure 6:
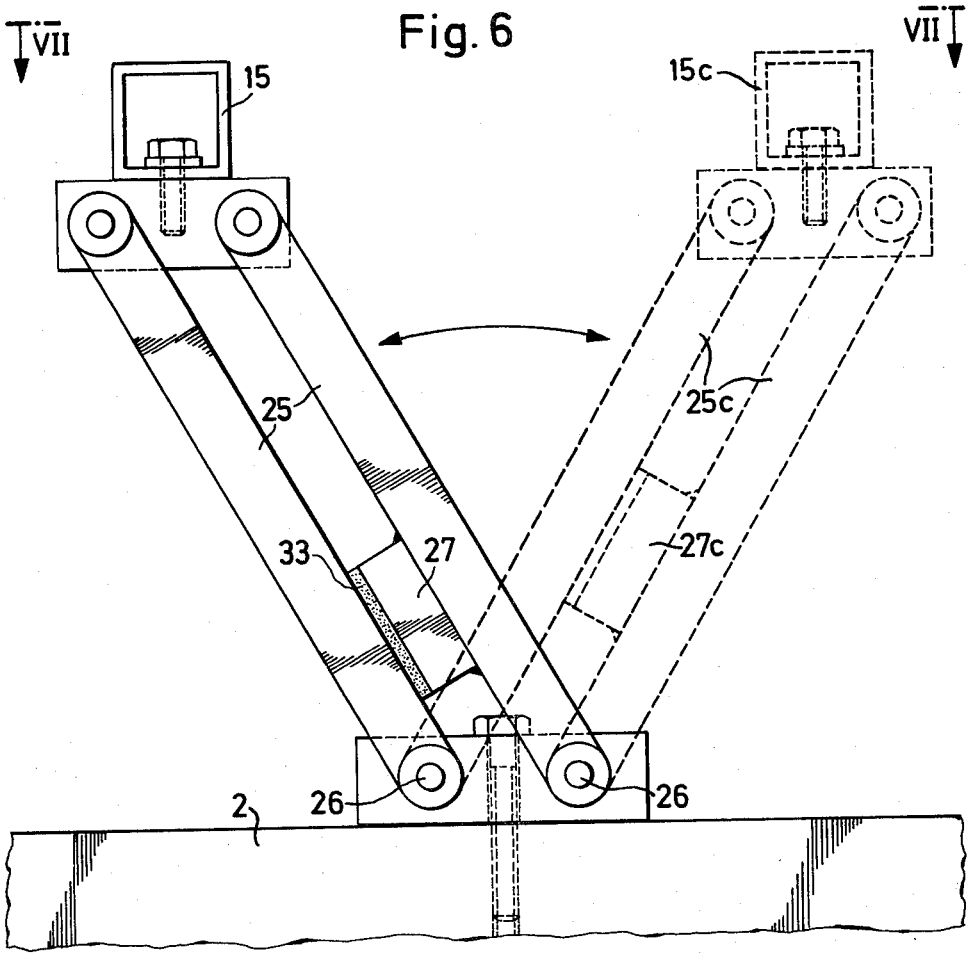
FIG. 6 illustrates a detail thereof on an enlarged scale.
Figure 7:
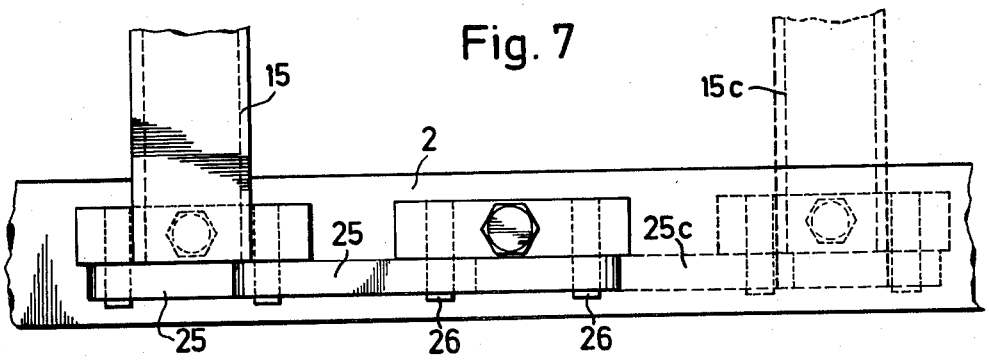
FIG. 7 is a top plan view of the arrangement of FIG. 6, taken substantially along the line VII—VII thereof.

With the embodiment of FIG. 5, the longitudinal beam 15 is arranged upon a linkage-parallelogram 25 which can be pivoted or rocked about the hinge points or pivot locations 26 and, in the showing of FIG. 5, can be transferred from the full-line position into the phantom line position 25*c*. Between both of the rods or links 25 there is arranged a spacer element 27, as best seen by referring to FIG. 6, which, for instance, can be welded at the link or rod 25 at the right of FIG. 6 and equipped with a contact or support member 33 formed of an elastic material, for instance, rubber. By means of the spacer element 27 there is fixed both of the positions over the rear shed 7 and the front shed 9.

Now by referring to FIGS. 8–11 it will be apparent that the flap members 19 and 21 can be, for instance, manually moved into their upper positions by means of the pivotable levers 31, weight-compensating means, here shown for instance as gas-pressure cushions or springs 32, and links or rods 38. The longitudinal beam or support 15, shown to be of hollow cross-sectional configuration, simultaneously serves as an air flow channel and is provided with air throughflow openings or ports 35, as best seen for instance by referring to FIG. 11. It is, therefore, possible to deliver through the longitudinal beam 15, for instance air which has been particularly humidified for yarn and cloth and supplied by, for instance, any suitable air climatizing installation, the air being supplied to the space below the flap members 19 and 21. Also, if desired, air can be removed from such area, whereby it is possible at the same time to withdraw fiber fly, oil mist, and other contaminations away from the textile machine, here the loom.

Figure 9:
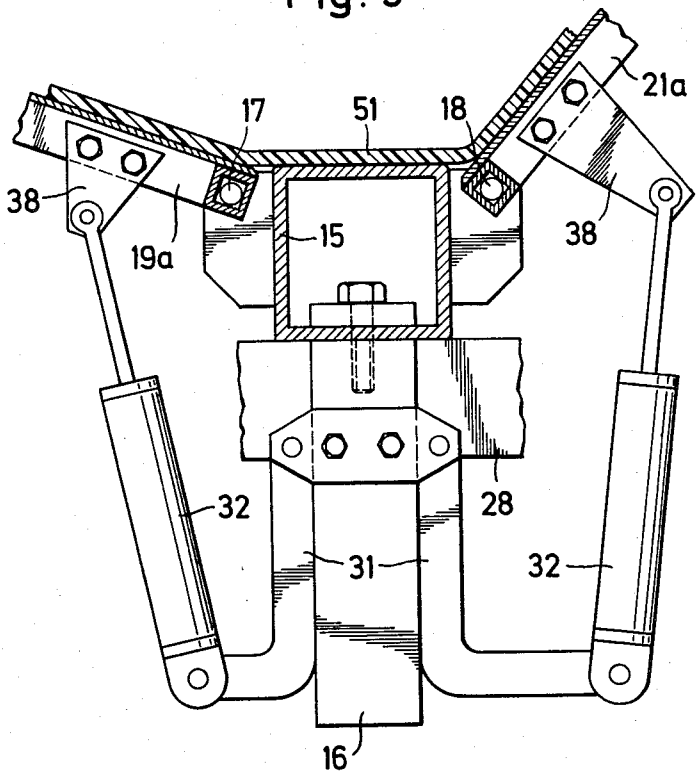
FIGS. 9 and 10 respectively show further positions of the structure of FIG. 8.
Figure 8:
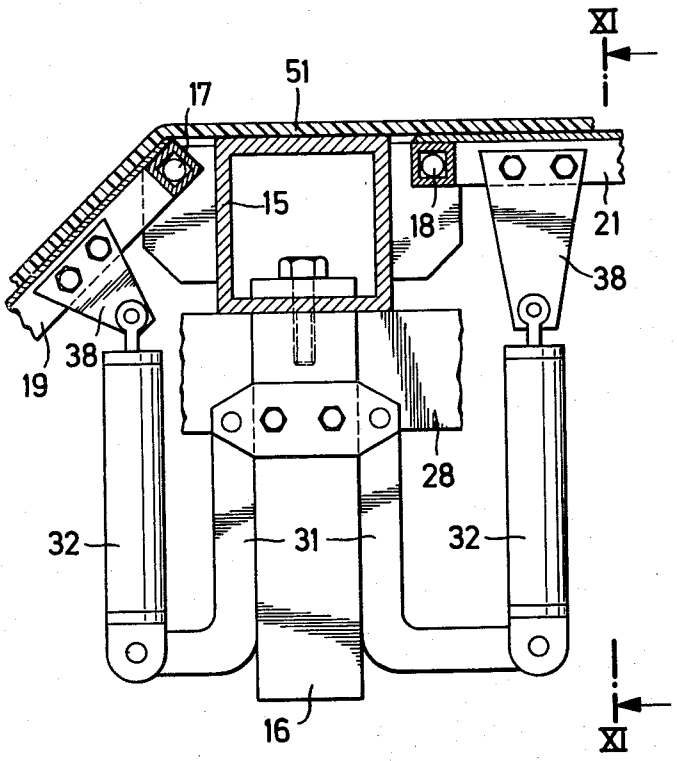
FIG. 8 is a cross-sectional view, taken substantially along the line VIII—VIII of FIG. 1.
Figure 11:
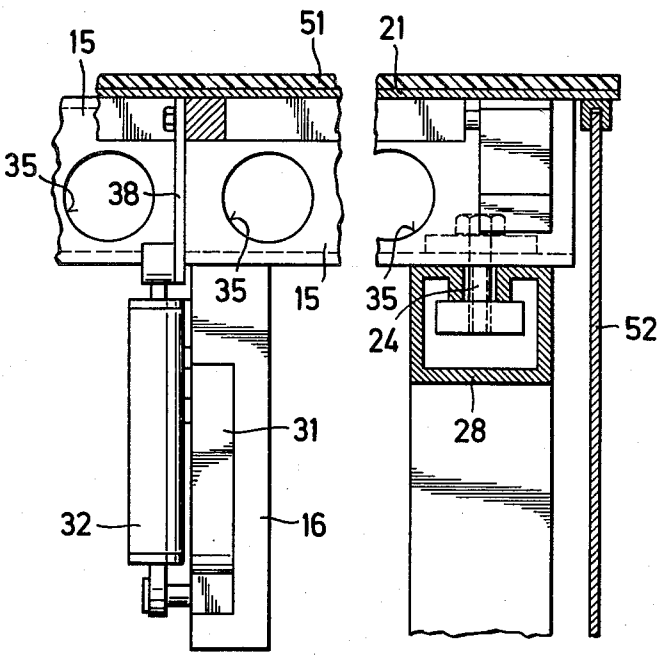
FIG. 11 is a cross-sectional view, taken substantially along the line XI—XI of FIG. 8.
Figure 10:
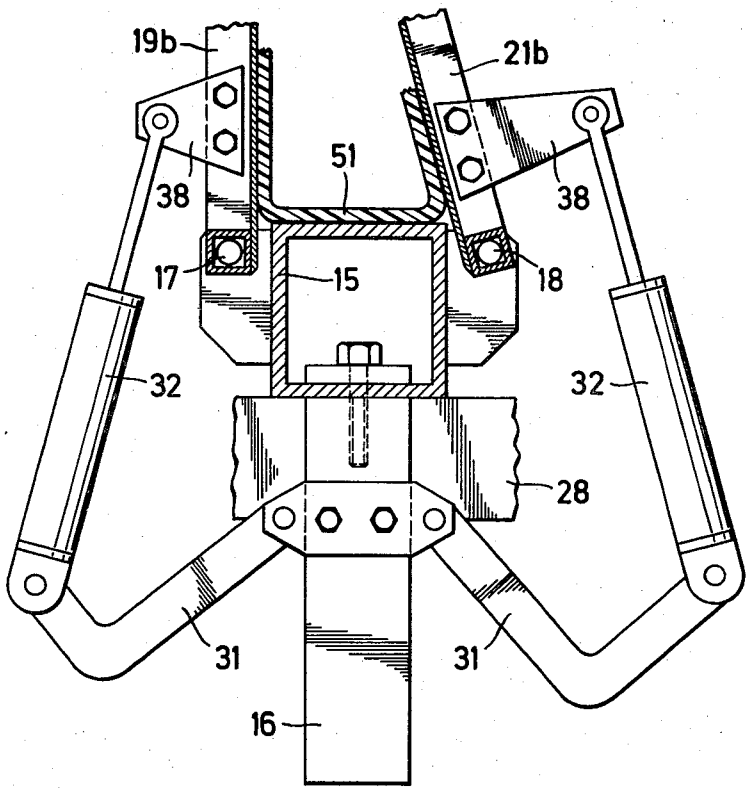

With the embodiment shown in FIGS. 9–11, the flap or cover members 19 and 21 are covered by means of a soft-elastic mat 51. This mat 51 can be, for instance, adhesively bonded to the longitudinal beam or support 15.

Figure 2:
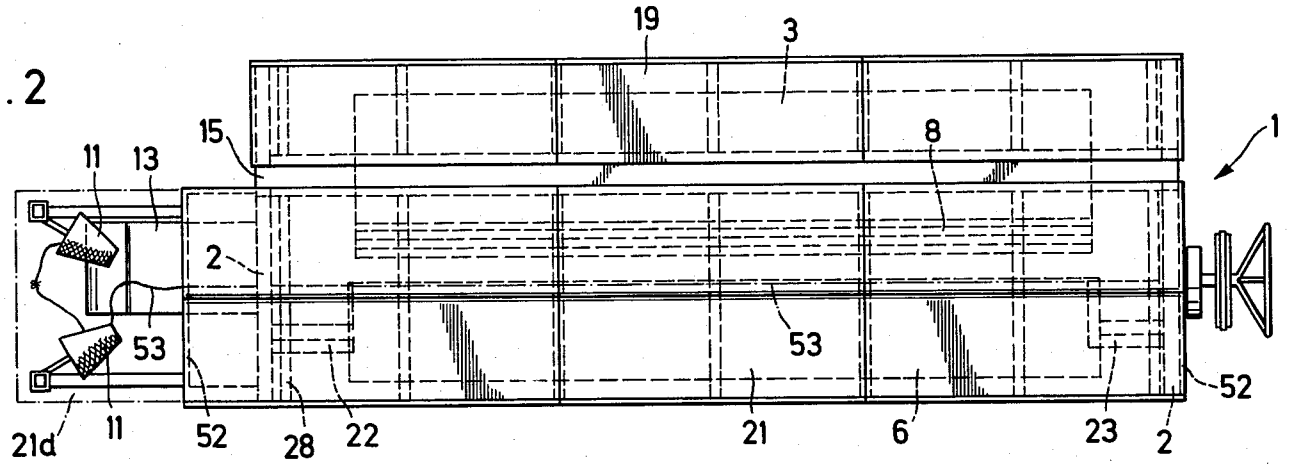
FIG. 2 is a top plan view of the loom shown in FIG. 1.

As also best seen by referring to FIGS. 1 and 2, each of the flap members 19 and 21 are formed of one-piece. When working with wider looms it is, of course, possible to arrange adjacent one another a number of such flap members. Also the regions of the bobbins 11 can be located below a cover flap 21*d*, as shown in FIG. 2.

Further, as illustrated in FIGS. 1, 2 and 11, the end faces or sides of the loom can be covered by plates 52 which may constitute an upper extension of the side plates 2 of the loom 1.

Instead of using the gas-pressure springs or cushions 32, it is also possible to employ mechanical springs. Also, as shown in FIG. 4, an air flow or guide channel 15*a* can be mounted, for instance, at the flap or cover member 21.

While there are shown and described present preferred embodiments of the invention, it is to be distinctly understood that the invention is not limited thereto, but may be otherwise variously embodied and practiced within the scope of the following claims. Accordingly,

What I claim is:

1. A loom comprising a first deflection beam located at the side of the warp ends, a second deflection beam located at the side of the woven cloth, said first and second deflection beams essentially bounding a weaving plane, a cover arrangement provided for the loom, said cover arrangement extending only above the weaving plane essentially from the first deflection beam at the side of the warp ends to the second deflection beam at the side of the woven cloth, shed forming mechanism for forming a front shed and a rear shed, a longitudinal beam arranged above the rear shed, said rear shed extending from the first deflection beam to said shed forming mechanism, said front shed extending from the shed forming mechanism to the second deflection beam, said cover arrangement comprising at least one flap member for covering the rear shed, at least one flap member for covering the front shed, means for hingedly connecting said two flap members at said longitudinal beam, said flap members can be moved between a closed position covering the related rear shed and front shed and an opened position, and means for arranging said longitudinal beam together with the thereat hingedly connected flap members when in their open position for back-and-forth movement in the direction of the warp and substantially parallel to the weaving plane.

2. The loom as defined in claim 1, wherein said means arranging said longitudinal beam together with said flap members for back-and-forth movement comprises pivotable linkage mechanism.

3. The loom as defined in claim 2, wherein the pivotable linkage mechanism comprises a four-link mechanism.

4. The loom as defined in claim 1, further including an air flow channel means mounted at one of the flap members and upwardly pivotable together therewith.

5. A loom comprising a first deflection beam located at the side of the warp ends, a second deflection beam located at the side of the woven cloth, said first and second deflection beams essentially bounding a weaving plane, a cover arrangement provided for the loom, said cover arrangement extending only above the weaving plane essentially from the first deflection beam at the side of the warp ends to the second deflection beam at the side of the woven cloth, said cover arrangement being devoid of any parts extending below the weaving plane, shed forming mechanism for forming a front shed and a rear shed, a longitudinal beam arranged above the rear shed, said rear shed extending from the first deflection beam to said shed forming mechanism, said front shed extending from the shed forming mechanism to the second deflection beam, said cover arrangement comprising at least one flap member for covering the rear shed, at least one flap member for covering the front shed, means for hingedly connecting said two flap members at said longitudinal beam, and said longitudinal beam is structured to provide an air flow channel.

6. A loom comprising a first deflection beam located at the side of the warp ends, a second deflection beam located at the side of the woven cloth, said first and second deflection beams essentially bounding a weaving plane, a cover arrangement provided for the loom, said cover arrangement extending only above the weaving plane essentially from the first deflection beam at the side of the warp ends to the second deflection beam at the side of the woven cloth, said cover arrangement being devoid of any parts extending below the weaving plane, shed forming mechanism for forming a front shed and a rear shed, a longitudinal beam arranged above the rear shed, said rear shed extending from the first deflection beam to said shed forming mechanism, said front shed extending from the shed forming mechanism to the second deflection beam, said cover arrangement comprising at least one flap member for covering the rear shed, at least one flap member for covering the front shed, means for hingedly connecting said two flap members at said longitudinal beam, and said longitudinal beam is provided with air throughflow openings below the flap members.

7. A loom comprising a first deflection beam located at the side of the warp ends, a second deflection beam located at the side of the woven cloth, said first and second deflection beams essentially bounding a weaving plane, a cover arrangement provided for the loom, said cover arrangement extending only above the weaving plane essentially from the first deflection beam at the side of the warp ends to the second deflection beam at the side of the woven cloth, said cover arrangement being devoid of any parts extending below the weaving plane, shed forming mechanism for forming a front shed and a rear shed, a longitudinal beam arranged above the rear shed, said rear shed extending from the first deflection beam to said shed forming mechanism, said front shed extending from the shed forming mechanism to the second deflection beam, said cover arrangement comprising at least one flap for covering the rear shed, at least one flap member for covering the front shed, means for hingedly connecting said two flap members at said longitudinal beam, means for weight-compensation upon actuation of the flap members, and said weight-compensation means comprising gas-pressure cushion means.

* * * * *